US005318641A

United States Patent [19]

Masumoto et al.

[11] Patent Number: 5,318,641

[45] Date of Patent: Jun. 7, 1994

[54] PARTICLE-DISPERSION TYPE AMORPHOUS ALUMINUM-ALLOY HAVING HIGH STRENGTH

[75] Inventors: Tsuyoshi Masumoto, 8-22, Kamisugi 3-chome, Aoba-ku, Sendai-shi, Miyagi-ken; Akihisa Inoue; Kazuhiko Kita, both of Sendai; Hitoshi Yamaguchi, Okaya; Hiroyuki Horimura; Noriaki Matsumoto, both of Wako, all of Japan

[73] Assignees: Tsuyoshi Masumoto, Miyagi; Teikoku Piston Ring Co., Ltd., Tokyo; Honda Giken Kogyo Kabushiki Kaisha, Tokyo; Yoshida Kogyo K.K., Tokyo, all of Japan

[21] Appl. No.: 710,035

[22] Filed: Jun. 6, 1991

[30] Foreign Application Priority Data

Jun. 8, 1990 [JP] Japan ..... 2-148770

[51] Int. Cl.[5] ..... C22C 45/08

[52] U.S. Cl. ..... 148/403; 420/550; 420/552

[58] Field of Search ..... 148/403, 437; 420/550, 420/552

[56] References Cited

U.S. PATENT DOCUMENTS

| | | | |
|---|---|---|---|
| 4,715,893 | 12/1987 | Skinner et al. | 148/403 |
| 4,743,317 | 5/1988 | Skinner et al. | 148/437 |
| 5,053,084 | 10/1991 | Masumoto et al. | 148/403 |

FOREIGN PATENT DOCUMENTS

| | | |
|---|---|---|
| 0317719A1 | 5/1989 | European Pat. Off. . |
| 0339676A1 | 11/1989 | European Pat. Off. . |
| 3524276A1 | 1/1986 | Fed. Rep. of Germany . |
| 61-41732 | 2/1986 | Japan . |
| 2236325 | 4/1991 | United Kingdom . |

OTHER PUBLICATIONS

Journal of Materials Science, vol. 22, No. 1, Jan. 1987, pp. 202–206 Chapman and Hall Ltd; Y. R. Mahajan et al.: "Rapidly Solidified microstructure of Al–8Fe–4 lanthanide alloys".

Japanese Journal of Applied Physics, vol. 27, No. 3, Mar. 1988, pp. L280–L282; A. Inoue et al.: "New amorphous alloys with good ductility in Al–Y–M and Al–L-a–M (M=Fe, Co, Ni or Cu) systems".

*Primary Examiner*—George Wyszomierski

*Attorney, Agent, or Firm*—Armstrong, Westerman, Hattori, McLeland & Naughton

[57] ABSTRACT

$Al_{100-a-b-c}X_aM_bT_c$, in which X is Y (yttrium) and/or rare-earth element(s), M is Fe, Co, and/or Ni, and T is Mn, Mo, Cr, Zr and/or V, and, a=0.5–5 atomic %, b=5–15 atomic %, and c=0.2–3.0 atomic %, and, further, X and M fall on and within the hatched region range of the appended FIG. 1, has a complex, amorphous-crystalline structure with an amorphous matrix containing the Al, X, M and T, and minority crystalline phase consisting of aluminum-alloy particles containing super-saturated X, M and T as solutes. The alloy has a high strength due to the dispersed crystalline particles.

6 Claims, 4 Drawing Sheets

PARTICLE-DISPERSION TYPE AMORPHOUS ALUMINUM-ALLOY HAVING HIGH STRENGTH

BACKGROUND OF INVENTION

1. Field of Invention

The present invention relates to an amorphous alloy, whose strength is enhanced by means of dispersing fine crystalline particles.

2. Description of Related Arts

Heretofore, various amorphous aluminum-alloys are known in Japanese Unexamined Patent Publication No. 64-47,831. It is intended in every one of these aluminum-alloys to form a single amorphous phase so as to promote the strength-enhancement. It is proposed in Japanese Unexamined Patent Publication No. 2-59,139 that the crystalline particles be dispersed in the amorphous structure and hence enhance the strength. The amount of the crystalline particles dispersed is determined by the cooling speed and the composition of the mother alloy, specifically, the relationship between the amount of rare earth element(s) and the amount of Fe, Co and Ni. Desirably, the dispersion particles should have high strength and should have close inter-particle distance considering the theory of the law of mixtures. It is therefore desired that the inter-particle distance be shortened by controlling the cooling speed. Although, such controlling is not very effective for controlling the inter-particle distance, there are no other means than the cooling speed-control.

There is no clear and concrete theory for explaining the strengthening mechanism of the composite amorphous material, in which the crystalline particles are dispersed in the amorphous matrix. It seems however that the following requirements are given for the particles which greatly contribute to the enhancement: (1) the strength of dispersion particles is high; (2) good coherency is realized between the dispersion particles and the matrix; and, (3) inter-particle distance (λ) is small.

The inter-particle distance (λ) is greatly influenced by the following geometrical parameters and is expressed by:

$$\lambda=(\tfrac{2}{3})d(1-V_p)/V_p,$$

in which d is the diameter of a particle, and $V_p$ is the volume of a particle (M, GENSAMER; Trans. ASM, 36(1946), 30). It is believed that the λ reduction is effective for enhancing the tensile strength. The yield strength $\delta_{0.2}$ is expressed by:

$$\delta_{0.2} \propto V_p^{3/2} \cdot d^{-1}$$

A small (d) is therefore effective for enhancing the yield strength. There are two methods for decreasing the inter-particle distance (λ), namely decreasing the diameter of a particle (d), and increasing the volume of a particle ($V_p$). The latter method for increasing the volume of a particle incurs, however, reduction in elongation and hence impairment of toughness.

SUMMARY OF THE INVENTION

It is therefore an object of the present invention to provide a particle-dispersion type amorphous aluminum-alloy, in which the diameter of the crystalline particles is decreased to enhance the strength.

In accordance with the present invention, there is provided a particle-dispersion type amorphous aluminum alloy, which has the following composition $Al_{100-a-b-c}X_aM_bT_c$, in which X is one or more of Y(yttrium) and rare-earth elements, M is one or more of Fe, Co and Ni, and, T is one or more of Mn, Mo, Cr, Zr and V, and, further the content "a" of X is from 0.5 to 5 atomic %, the content "b" of M is from 5 to 15 atomic %, and the content "c" of T is from 0.2 to 3.0 atomic %, and, further, the contents of X and M fall on and within the hatched range of the appended FIG. 1, and, which has a structure with an amorphous matrix phase containing the elements Al, X, M, and T, and with crystalline Al-alloy particles dispersed in said amorphous matrix and containing super-saturated X, M and T solute elements.

The crystalline particles, which are dispersed in the matrix, i.e., the amorphous phase, have Al-X(Y and/or a rare earth element(s))-M(Fe, Co and/or Ni)-T(Mo, Mn, Cr, Zr and/or V) and a single-phase FCC(face centered cubic) matrix, in which X, M and T are supersaturated in Al as the solute atoms. The components consisting of Al-X(Y and/or a rare earth element(s))-M(Fe, Co and/or Ni) are fundamental elements which form an amorphous alloy exhibiting 50 kg/mm$^2$ or more of tensile strength. The alloy according to the present invention is one in which the crystalline particles from a few nanometers (nm) to a few tens of nanometers (nm) in size are dispersed in the amorphous alloy having the above mentioned tensile strength. The crystalline particles therefore disperse in the amorphous alloy and dispersion-strengthen it. The above elements T(Mo, Mn, Cr, Zr and/or V) are additive elements added to the above amorphous alloy having the fundamental elements and, when added in a particular amount, greatly enhance the strength of such amorphous alloy. It seems, as a result of detailed study of the material structure, that outstanding strengthening is attributable to (1) the small size of the crystalline particles in the range of a few nanometers to a few tens of nanometers, (2) uniform dispersion of the crystalline particles, and (3) appreciable solution-strengthening of the crystalline particles.

Reasons for limiting the composition range according to the present invention are described hereinafter.

When aluminum, which is the major element in the present invention, is less than 80 atomic %, such aluminum compounds as $Al_3Y$ and $Al_3Ni$, are liable to be generated in the crystalline dispersion phase or to generate as an independent crystalline phase during the production of the amorphous alloy. As a result, the amorphous alloy embrittles. On the other hand, when the aluminum content exceeds 94.5 atomic %, it becomes difficult by ordinary cooling speed of the melt to obtain the mixed structure of the crystalline and amorphous phases. When the cooling speed is enhanced to more than the ordinary level, not only productivity is lessened but also the heat-resistance of the amorphous alloy is lessened. The aluminum content is therefore preferably from 80 to 94.5 atomic %.

M and X are necessary for vitrifying the aluminum-based alloy. X is one or more elements selected from Y(yttrium) and rare earth elements, such as La, Ce, Sm, Nd and Gd. The content of X is 0.5 atomic % or more, because at a content less than 0.5 atomic % a mixed structure of the amorphous and crystalline phases is difficult to obtain. The content of X is 5 atomic % or less, because at a content of more than 5 atomic % macro crystallites are formed. In this case, the alloy having the mixed phase embrittles.

M is element necessary for forming the amorphous alloy and is contained in both the amorphous and crystalline phases. The matrix and crystalline particles are strengthened by M. When the content of M is less than 5 atomic %, the vitrifying ability of the alloy is so poor that industrial vitrification of such an alloy is difficult. On the other hand, when the content of M exceeds 15 atomic %, intermetallic compounds are formed and precipitate in the amorphous phase.

Figure 1:
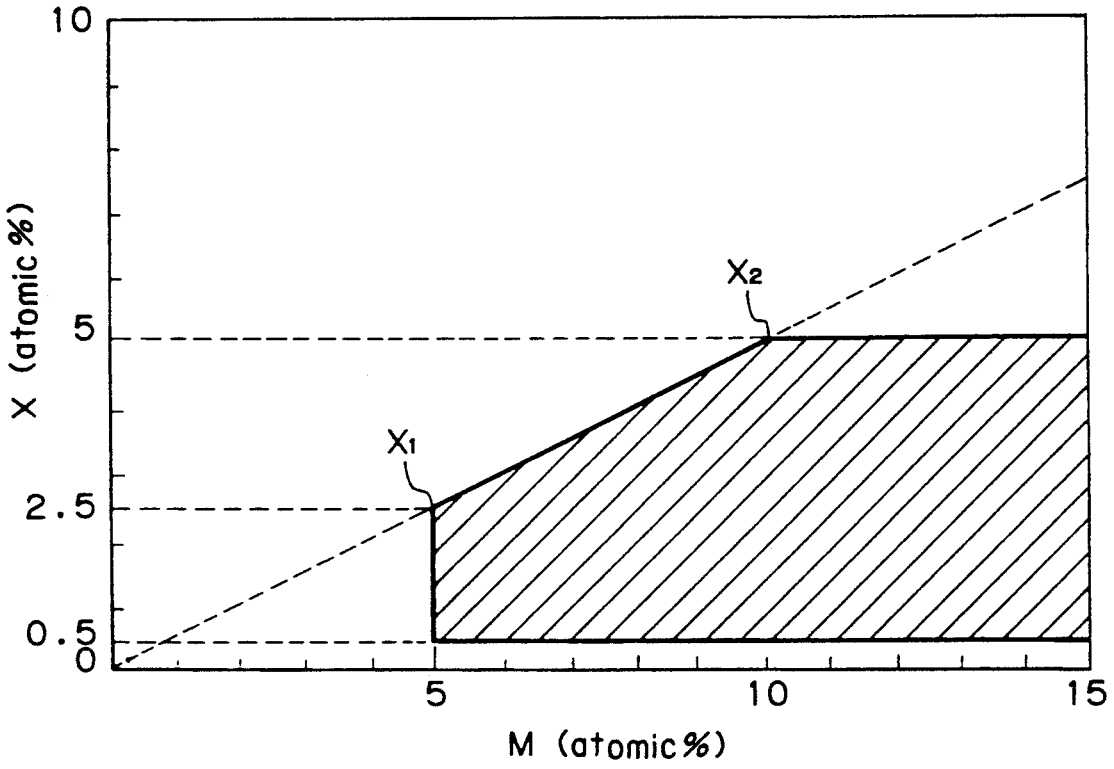
FIG. 1 is a graph illustrating the relationship between the composition range of X and M according to the present invention.

Referring to FIG. 1, the relationship between the X and M contents are shown. When the content of X is more than the line $X_1X_2$, that is, the content of M is less than the line $X_1X_2$, the precipitation of α-aluminum becomes difficult.

T, i.e., Mo, Mn, Cr, Zr and/or V, is effective for decreasing the diameter of the dispersion particles and solution-strengthening the dispersion particles. When the content of T is less than 0.2 atomic %, refinement and solution-strengthening of the dispersion particles are not satisfactory. On the other hand, when the content of T is more than 3.0 atomic %, the vitrification ability of the alloy is so impeded that productivity is lessened. In addition, it becomes difficult to vitrify the alloy by adjusting the cooling speed, which is industrially applicable.

The crystalline particles preferably have an average diameter of from 1 nm to 100 nm. The crystalline particles are preferably present in an amount of from 5 to 40% by volume, more particularly from 10 to 30% by volume.

The complex, crystalline and amorphous structure may be formed by heat treating the completely amorphous alloy. However, the growth speed of the crystals is faster in the heat-treating method than in the method of cooling the molten alloy. The crystals coarsen therefore during the heat treatment larger than the preferable diameter and volume content. In addition, the crystals disperse non-uniformly and segregate, so that the strength and toughness of the heat-treated alloy are low.

The present invention is hereinafter described with reference to the examples.

EXAMPLE

Figure 2:
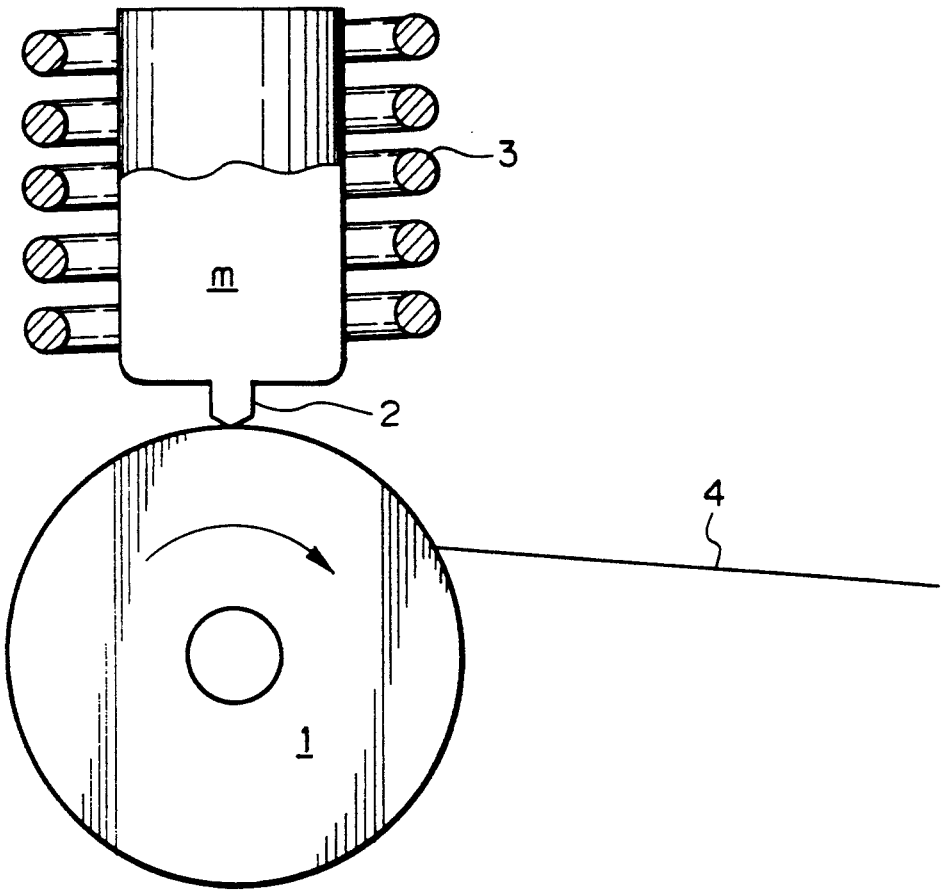
FIG. 2 is a schematic drawing illustrating an apparatus for producing an amorphous alloy.

Referring to FIG. 2, an apparatus for producing the amorphous alloys is illustrated. This apparatus is a single-roll type and is provided with the cooling roll 1, nozzle 2 and high-frequency induction heating coil 3. The cooling roll 1 is made of chromium-copper and rotates clockwise as shown in the drawing. The nozzle 2 is made of quartz and has an outlet 2. The nozzle 2 is stationary so that the outlet 2 is positioned in the proximity of the outer circumference of the cooling roll 1. The nozzle 2 is heated by the high-frequency induction heating coil 3. The members 1, 2 and 3 may be kept in an inert atmosphere.

In the present example, a cooling roll 1 with a diameter of 200 mm, and a nozzle 2 with an outlet diameter of 0.3 mm were used. The gap between the outlet of the nozzle and the outer circumference of the cooling roll 1 was set at 1.5 mm. The ambient gas around the apparatus shown in FIG. 1 was argon which was usually used for the production of amorphous aluminum alloys.

Ingots of mother alloys having these particular compositions were first prepared. The ingot was then weighed in a particular amount and loaded in the nozzle 2. The ingot was then induction-melted by the high-frequency induction heating coil 3 to provide the molten alloy denoted in FIG. 2 as "m". The molten alloy m was ejected through the outlet of the nozzle 2 onto the outer circumference of the cooling roll 1 by argon gas having a typical pressure of 0.4 kg/cm$^2$. The molten alloy was then deposited and cooled on the outer circumference of the cooling roll 1 and subsequently pulled out in the form of a ribbon 4. The thickness of the ribbon was 0.015 mm. As soon as the ribbon 4 was formed, it was rapidly cooled. When the cooling speed was made slower by adjusting the rotation speed of the cooling roll 1 to less than the level for obtaining the single-phase amorphous alloy, i.e., the alloy having 100% by volume of amorphous components, the crystalline phase appears partially in the alloy during solidification of the amorphous alloy. As a result, the obtained ribbon has a complex structure such that the matrix of the aluminum alloy is amorphous and consists of Al, X, M and T, while the minority phase consists of the finely distributed particles of α-aluminum (FCC-Al). The aluminum alloy is therefore considerably strengthened.

EXAMPLE 1

The amorphous alloy having the composition $Al_{88}Y_2Ni_9Mn_1$ was produced by the method described above. The alloys A through D given in Table 1 were produced by varying the rotatation speed of the cooling roll 1, so as to investigate the relationship between the rotation speed and the proportion of the amorphous phase. The result is given in Table 1.

TABLE 1

| Amorphous Alloys | Rotation Number of Cooling Roll (rpm) | Proportion of Crystalline phase (Vol. %) |
|---|---|---|
| A | 4000 | 0 |
| B | 3000 | 4 |
| C | 2000 | 19 |
| D | 1000 | 42 |

The crystalline particles were super-saturated solid solution of Al.

Figure 3:
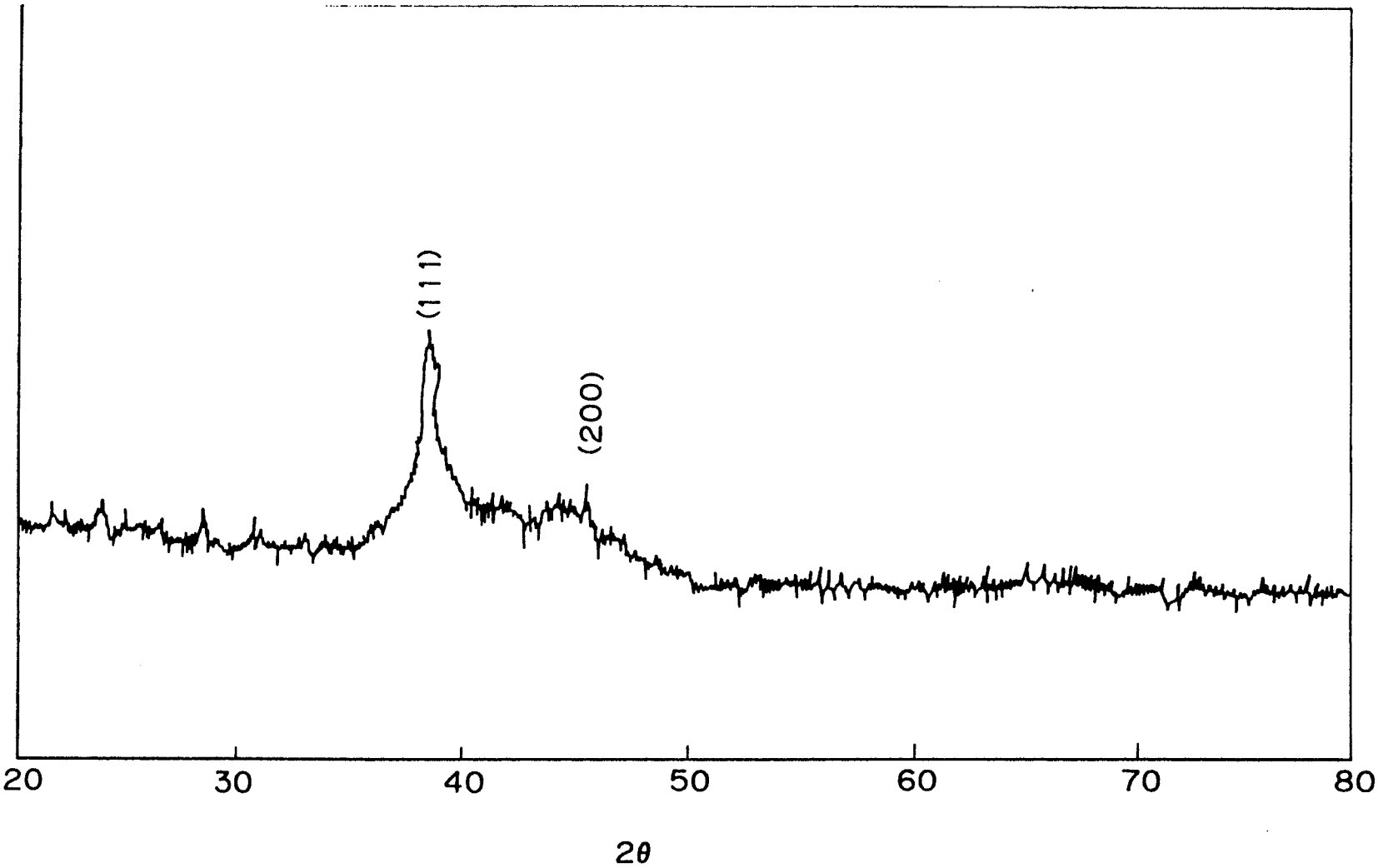
FIG. 3 is a diffraction figure of an alloy according to the present invention, given in Example C.

Referring to FIG. 3, the X-ray diffraction chart of Amorphous Alloy C is shown. The anode of an X-ray tube used was Cu, and $K_\alpha$ line was used. FIG. 3 indicates that Amorphous Alloy C has a structure that the crystalline α-Al precipitates in the amorphous matrix.

EXAMPLE 2

Figure 4:
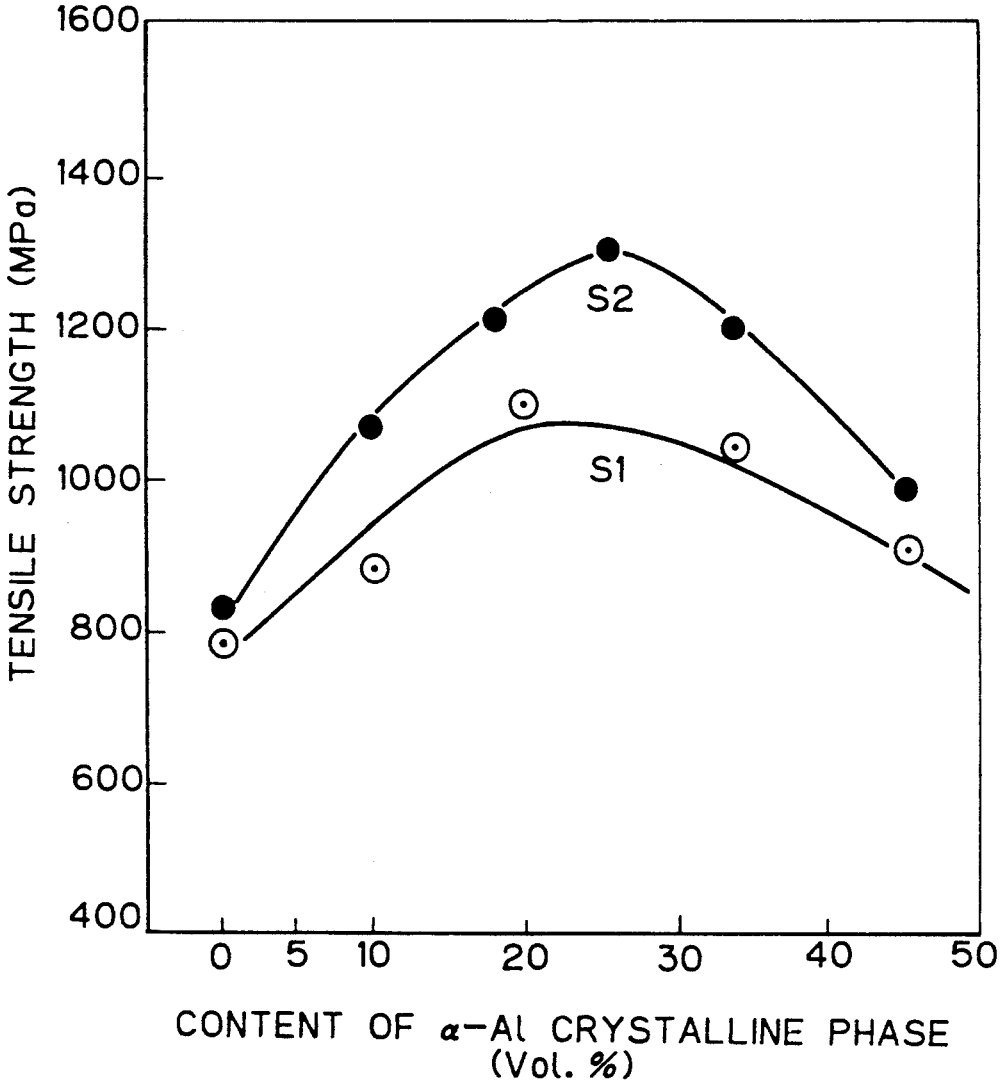
FIG. 4 is a graph illustrating the tensile strength of the inventive and comparative amorphous alloys.

The inventive composition $Al_{88}Y_2Ni_9Mn_1$ and the comparative composition $Al_{88}Y_2Ni_{10}$ were melted and solidified as in Example 1, while varying the rotation speed of the cooling roll. Referring to FIG. 4, the relationship between the tensile strength and the volume content of the α-Al crystalline phase is shown with regard to the inventive composition $Al_{88}Y_2Ni_9Mn_1$ denoted as "S2" and the comparative composition $Al_{88}Y_2Ni_{10}$ denoted as "S1".

As is apparent from FIG. 4, the strength of the complex, amorphous-crystalline alloy is higher than the single amorphous-phase alloy. The strength of the amorphous $Al_{88}Y_2Ni_9Mn_1$ free of crystalline phase is virtually the same as that of the comparative $Al_{88}Y_2Ni_{10}$ free of Mn. Mn added to the completely amorphous alloy therefore does not strengthen it. Contrary to this, Mn added to the inventive composition strengthen the alloy, when the crystalline phase precipitates. That is, the tensile strength of the comparative alloy free of Mn and containing the crystalline phase is 110 kg/mm$^2$, while the tensile strength of the inventive alloy containing Mn and crystalline phase is 130 kg/mm$^2$. Approximately 40 volume % of the α-Al crystalline phase is composition at which the embrittlement of the inventive alloy $Al_{88}Y_2Ni_9Mn_1$ and the comparative $Al_{88}Y_2Ni_{10}$ starts due to the crystalline phase.

It turned out as a result of the transmission-type electron microscope (TEM-200 kV) observation of the $Al_{88}Y_2Ni_9Mn_1$ having a complex structure, that the α-Al having a particle diameter from a few nanometers to a few tens of nanometers was present in the form of spots in the amorphous matrix. It also turned out as a result of the TEM observation of $Al_{88}Y_2Ni_{10}$ having a complex structure that the α-Al having a particle diameter from a few tens of nanometers to a few hundreds of nanometers was present in the form of spots in the amorphous matrix.

EXAMPLE 3

The alloys having the composition in Table 2 were melted and solidified by the method as described in Example 1. The structure and tensile strength of the alloys are given in Table 2.

TABLE 2

| No. | Chemical Composition (at %) Al | Y | La | Ce | Nd | Sm | Fe | Co | Ni | Mn | Mo | Cr | Zr | Structure | Tensile Strength (kg/mm$^2$) |
|---|---|---|---|---|---|---|---|---|---|---|---|---|---|---|---|
| Comparative 1 | Bal | 2 | — | — | — | — | — | — | 10 | — | — | — | — | Amorphous | 92 |
| Inventive 1 | Bal | 2 | — | — | — | — | — | — | 9 | 1 | — | — | — | Amorphous + Crystalline | 130 |
| Comparative 2 | Bal | — | 4 | — | — | — | — | — | 10 | — | — | — | — | Amorphous | 75 |
| Inventive 2 | Bal | — | 4 | — | — | — | — | — | 9 | — | — | — | 1 | Amorphous + Crystalline | 120 |
| Comparative 3 | Bal | — | 1 | 2 | 0.5 | 0.5 | — | — | 10 | — | — | — | — | Amorphous | 90 |
| Inventive 3 | Bal | — | 1 | 2 | 0.5 | 0.5 | — | — | 9 | — | 1 | — | — | Amorphous + Crystalline | 130 |
| Inventive 4 | Bal | — | 1 | 2 | 0.5 | 0.5 | 8 | — | — | 1 | — | — | — | Amorphous + Crystalline | 120 |
| Inventive 5 | Bal | | 1 | 2 | 0.5 | 0.5 | 8 | 1 | — | 1 | — | — | — | Amorphous + Crystalline | 130 |
| Inventive 6 | Bal | 2 | — | — | — | — | 1 | — | 8 | 1 | — | — | — | Amorphous + Crystalline | 130 |
| Inventive 7 | Bal | — | 1 | 2 | 0.5 | 0.5 | — | — | 9 | — | — | 0.5 | — | Amorphoul + Crystalline | 130 |

We claim:

1. A particle-dispersion amorphous aluminum alloy, which has the composition $Al_{100-a-b-c}X_aM_bT_c$, in which X is at least one element selected from the group consisting of yttrium and rare-earth elements, M is at least one element selected from the group consisting of Fe, Co, and Ni, and T is at least one element selected from the group consisting of Mn, Mo, Cr, Zr and V, wherein a of X is from 0.5 to 5 atomic %, b of M is from 5 to 15 atomic %, and c of T is from 0.2 to 3.0 atomic %, and, further, the amount of X and M falls on and within the hatched region of FIG. 1, alloy consisting essentially of a complex, amorphous-crystalline structure with an amorphous matrix containing the aluminum, X, M and T, and a secondary crystalline phase consisting of solid-solution aluminum-alloy particles, which are present in an amount of from 5 to 40% by volume, distributed in said matrix and containing super-saturated X, M and T as solutes, and having an average diameter of from 1 nm to 100 nm, and substantially free of intermetallic compounds.

2. A particle-dispersion amorphous aluminum alloy according to claim 1, wherein said alloy is in the form of a rapidly cooled ribbon in a cast state.

3. A particle-dispersion amorphous aluminum alloy according to claim 1, wherein T is Mn.

4. A particle-dispersion amorphous aluminum alloy according to claim 3, wherein said alloy is in the form of a rapidly cooled ribbon in a cast state.

5. A particle-dispersion amorphous aluminum alloy which has the composition $Al_{100-a-b'-b''-c}X_aM_{b'}Fe_{b''}T_c$, in which X is at least one element selected from the group consisting of yttrium and rare-earth elements, M is at least one element selected from the group consisting of Co, and Ni, and T is at least one element selected from the group consisting of Mn, Mo, Cr, Zr and V, wherein a of X is from 0.5 to 5 atomic %, b of M plus Fe ($b=b'+b''$) is from 5 to 15 atomic %, b'' of Fe is 0 or from 9 to 15 atomic %, and c of T is from 0.2 to 3.0 atomic %, and, further, the contents of a and $b+b'$ fall on and within the hatched region range of the appended FIG. 1, which alloy essentially consists of a complex, amorphous-crystalline structure with an amorphous matrix containing the aluminum, X, M, Fe and T, and a secondary crystalline phase consisting of a solid-solution aluminum-alloy particles which are present in an amount of from 5 to 40% by volume, distributed in said matrix and containing super-saturated X, M and T as solutes, and having an average diameter of from 1 nm to 100 nm, and substantially free of intermetallic compounds.

6. A particle-dispersion amorphous aluminum alloy according to claim 4, wherein said alloy is in the form of a rapidly cooled ribbon in a cast state.

* * * * *